US005857516A

United States Patent [19]

Jordison et al.

[11] Patent Number: 5,857,516

[45] Date of Patent: Jan. 12, 1999

[54] PRESSURE REDUCING HEAT EXCHANGER

[75] Inventors: Neville P. Jordison, Millarville; Peter H. Dawson, Okotoks, both of Canada

[73] Assignee: Cominco Engineering Services Ltd., Vancouver, Canada

[21] Appl. No.: 758,842

[22] Filed: Dec. 2, 1996

[51] Int. Cl.[6] ..... F28D 7/00

[52] U.S. Cl. ..... 165/159; 165/157; 165/161; 165/920; 34/165; 34/177

[58] Field of Search ..... 165/159, 161, 165/920, 157; 34/165, 177, 178

[56] References Cited

U.S. PATENT DOCUMENTS

| | | | |
|---|---|---|---|
| 735,878 | 8/1903 | Hutton | 34/165 X |
| 5,167,274 | 12/1992 | Mueller | 165/920 X |
| 5,320,168 | 6/1994 | Haight | 165/920 X |

*Primary Examiner*—Leonard R. Leo
*Attorney, Agent, or Firm*—Elbie R. de Kock

[57] ABSTRACT

A heat exchanger 10 comprises a pressure vessel 14 having a feed inlet 11 in an upper part thereof for particulate material to be subjected to heat exchange and an outlet 13 at a lower part thereof for the outflow of particulate material from the vessel 14. A plurality of heat exchange elements, such as heat exchange plates 12, arranged in spaced relationship inside the pressure vessel 14 to define flow passages between adjacent heat exchange elements 12 is provided for particulate material to flow therethrough under the force of gravity. The pressure vessel 14 has an inside wall extending around the heat exchange elements 12 and further comprises a trap, such as a baffle 22, between the heat exchange elements 12 and the inside wall for trapping particulate material leaking from the flow passages between the heat exchange elements 12 to form a gas barrier 26 between the heat exchange elements 12 and the pressure vessel 14. In one embodiment, a plurality of the traps 22, spaced along the heat exchange elements 12, are provided to form a plurality of separate gas barriers along the heat exchange elements 12. A method of effecting pressure reduction during a heat exchange operation, using the apparatus according to the invention, is also provided.

20 Claims, 5 Drawing Sheets

PRESSURE REDUCING HEAT EXCHANGER

FIELD OF THE INVENTION

This invention relates to a heat exchanger for heating or cooling material. In particular, it relates to a heat exchanger for heating or cooling particulate material and effecting a pressure reduction during the heat exchange process.

BACKGROUND OF THE INVENTION

In some metal recovery processes, such as the recovery of iron from ore, products are generated which are at a high temperature and pressure. One such product is, for example, iron carbide fines at a temperature of about 1000° F. in the presence of product gases at a pressure of about 50 psi. The product is delivered under high pressure from a reactor via a cyclone and requires cooling as well as pressure reduction down to atmospheric pressure.

It is accordingly an object of the present invention to provide a heat exchanger for heating or cooling a product, while at the same time effecting a pressure reduction.

SUMMARY OF THE INVENTION

According to the invention there is provided a method of effecting pressure reduction during a heat exchange operation, comprising the steps of introducing material to be subjected to heat exchange in particulate form into flow passages defined between a plurality of spaced heat exchange elements in a pressure vessel; permitting the material to flow in choked flow under the force of gravity through the flow passages defined between the heat exchange elements; permitting a portion of the material to leak from the passages between the heat exchange elements in a direction transversely of the flow passages; causing the leaked material to accumulate in a space adjacent the heat exchange elements to form a gas barrier extending between the heat exchange elements and the pressure vessel.

The method may further comprise the step of causing the leaked material to accumulate at a plurality of spaced locations along the heat exchange elements to form a plurality of separate gas barriers along the heat exchange elements.

The term "choked flow" in this specification means a flow other than a free fall of the individual particles under the force of gravity.

Also according to the invention there is provided a heat exchanger, comprising: a pressure vessel having a feed inlet in an upper part thereof for particulate material to be subjected to heat exchange and an outlet at a lower part thereof for the outflow of particulate material from the vessel; a plurality of heat exchange elements arranged in spaced relationship inside the pressure vessel to define flow passages between adjacent heat exchange elements for particulate material which is to be subjected to heat exchange to flow therethrough under the force of gravity; wherein the pressure vessel has an inside wall extending around the heat exchange elements and further comprising a trap between the heat exchange elements and the inside wall for trapping particulate material leaking from the flow passages between the heat exchange elements to form a gas barrier extending between the heat exchange elements and the pressure vessel.

A plurality of the traps, spaced along the heat exchange elements, may be provided to form a plurality of separate gas barriers along the heat exchange elements.

The heat exchange elements may comprise a plurality of heat exchange plates which are arranged in spaced parallel relationship to form a bank of plates with a rectangular cross-section.

The traps may comprise a plurality of baffles spaced along the bank of plates, the baffles extending between the inside wall of the pressure vessel and the bank of plates.

The baffles may be inclined downwardly from the inside wall of the vessel towards the bank of plates.

The baffles preferably have a shallow angle of incline, i.e. not more than about 45° with respect to the horizontal so that they will trap particulate material leaking from the flow passages between the heat exchange elements but will self empty when the flow of particulate material is terminated.

Other objects and advantages of the invention will become apparent from the description of a preferred embodiment of the invention below.

BRIEF DESCRIPTION OF THE DRAWINGS

The invention will now be described, by way of an example, with reference to the accompanying drawings, in which:

FIG. 2 is a side view at right angles to the side view of FIG. 1, showing the heat exchange plates edge-on.

DETAILED DESCRIPTION OF PREFERRED EMBODIMENT

Figure 1:
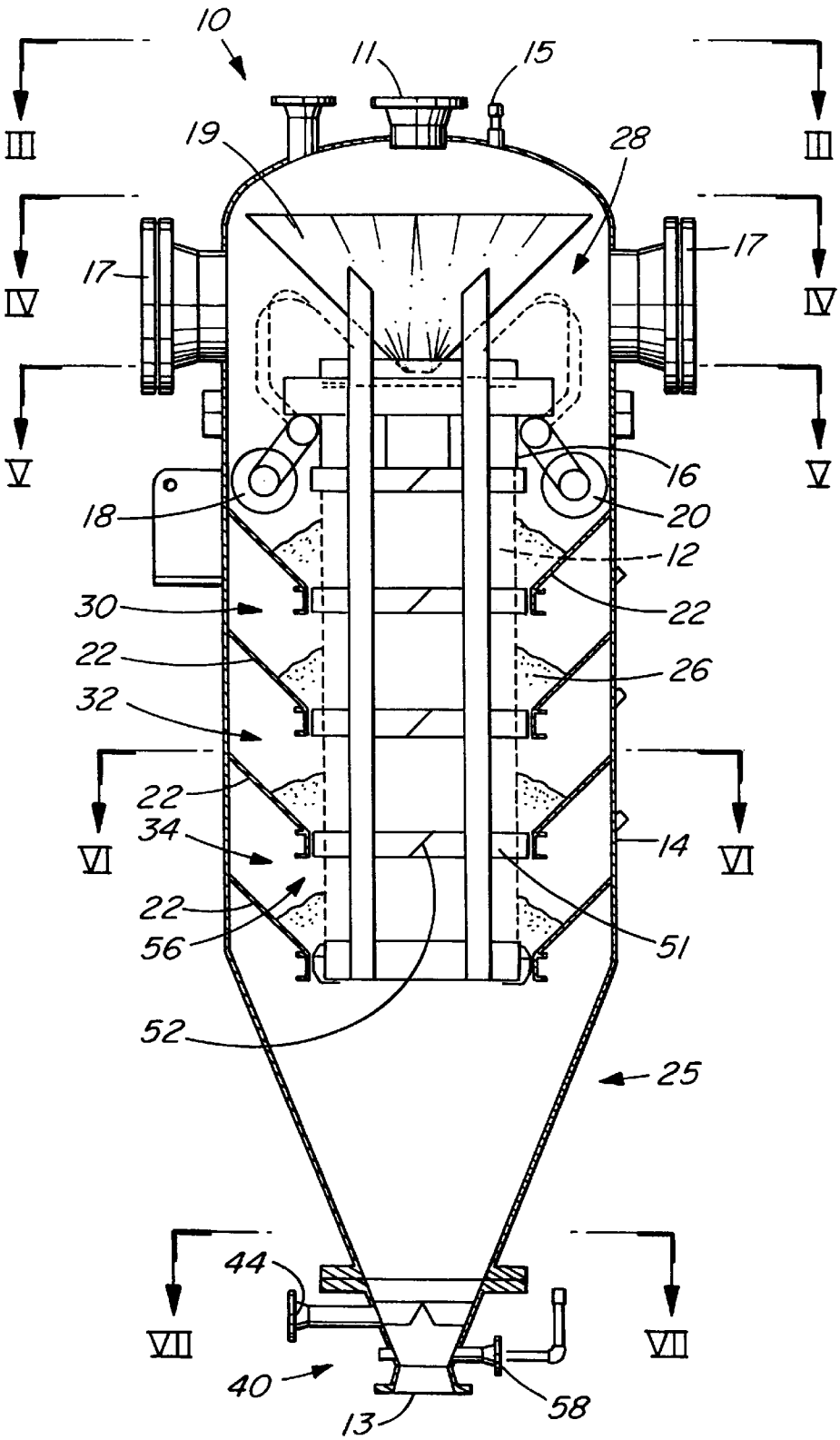
FIG. 1 is a part sectional side view of heat exchange apparatus according to the invention.
Figure 2:
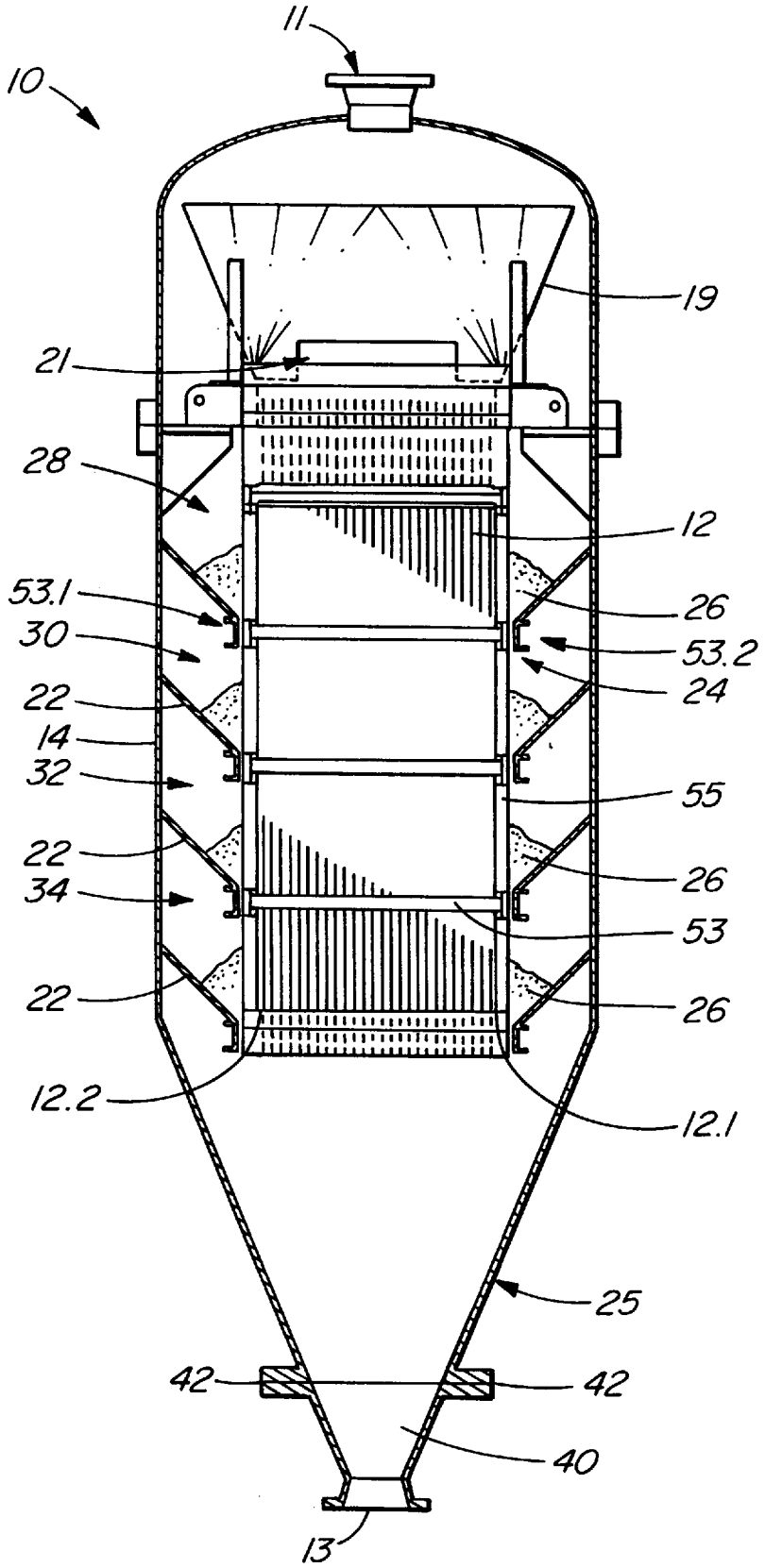
Figure 3:
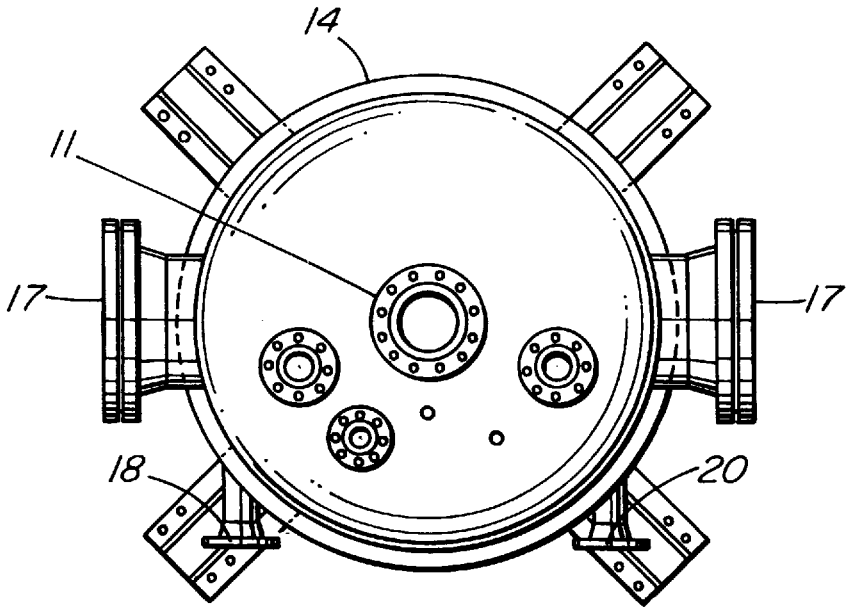
FIG. 3 is a top view of the apparatus of FIG. 1, as indicated by the lines III—III in FIG. 1.

Referring to FIGS. 1 and 2, reference numeral 10 generally indicates heat exchange apparatus, which in this particular example, is a cooler used for cooling fine particulate material, such as iron carbide from a reactor via a cyclone. The fines are mixed with process gases at a temperature of about 1000° F. and a pressure of about 50 psi.

The apparatus 10 comprises a bank of heat exchanger plates 12, arranged in spaced parallel relationship, located in a pressure vessel 14. The pair of outer heat exchange plates at the opposite sides of the bank of plates are referenced 12.1 and 12.2 and are referred to as "end plates".

The lower part of the pressure vessel 14 is conically shaped as indicated at 25 so as to achieve a choked mass flow of the particulate material through the bank of heat exchange plates 12.

The material is introduced through an inlet 11 at the top and exits the cooler 10 through an outlet 13 at the bottom. Reference numeral 15 indicates a temperature probe and reference numerals 17 indicate manways which can be opened to provide access to the upper part of the cooler 10.

Figure 4:
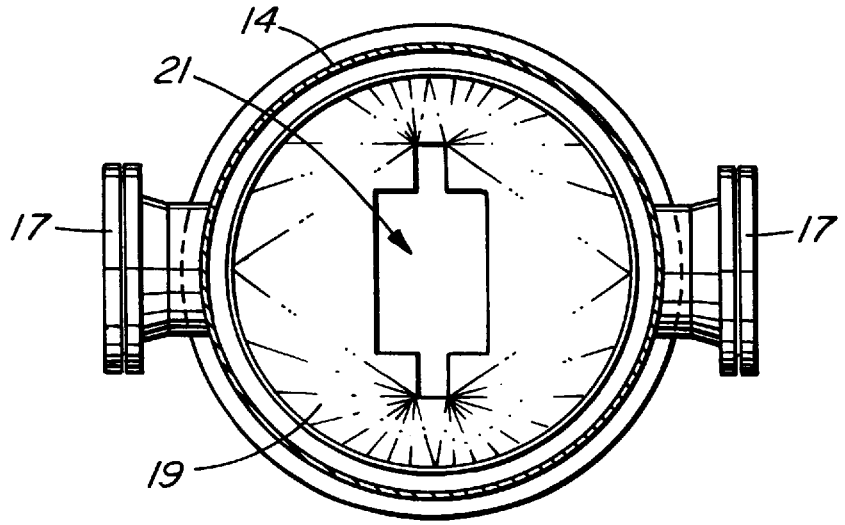
FIGS. 4 to 7, respectively, are sections taken along the lines IV—IV, V—V, VI—VI and VII—VII in FIG. 1.

A feed hopper 19 is provided above the bank of plates 12 for receiving the material being introduced through the inlet 11. The rates of inflow and outflow to the cooler 10 are controlled so that there is always a head of material in the hopper 19. The hopper 19 has a rectangular outlet 21 of the shape as shown in FIG. 4. It has been found that this keeps the tops of the plates 12 completely covered with the particulate material.

Figure 5:
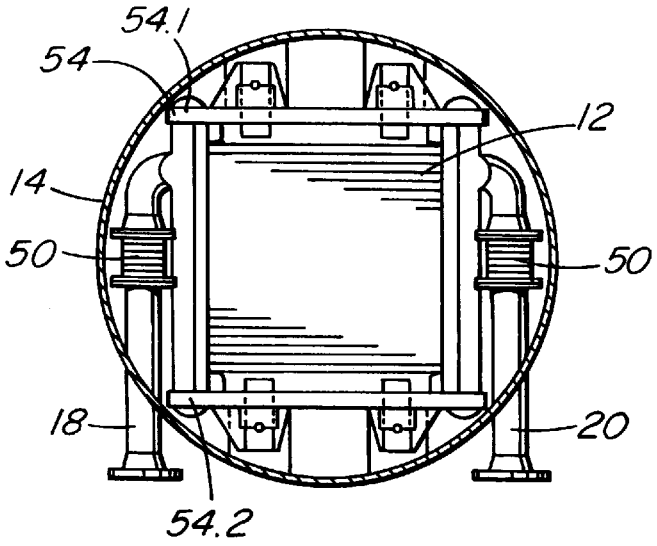
Figure 6:
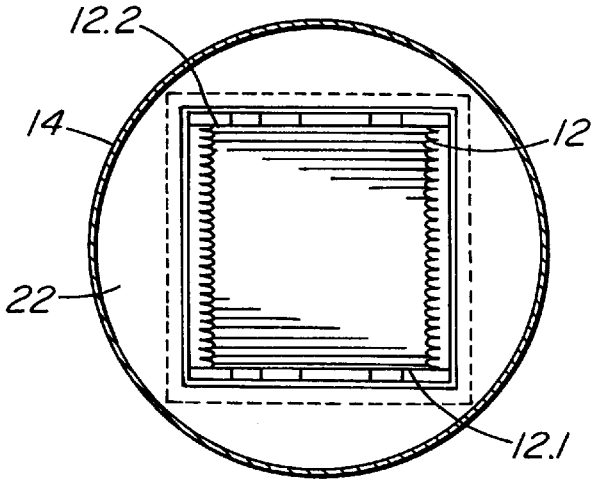

As can be seen from the FIGS. 5 and 6, the bank of plates 12 is rectangular in plan view and surrounded by the pressure vessel 14, which is circular in cross-section.

The spaces at the ends of plates 12 between adjacent plates are open, except for the upper part which is encased, as indicated by the solid line 16 in FIG. 1. This is to protect the upper parts of the apparatus, such as the coolant inlet 18, coolant outlet 20 and cooler heads, transferring coolant to and from the plates 12, from the hot material being introduced into the apparatus 10.

A series of baffles 22, spaced along the length of the pressure vessel 14, are provided. In the present example there are four baffles 22 but this number can vary depending on such factors as pressure and temperature drop in the apparatus and the nature of the material being subjected to heat transfer, such as cooling in the present example.

Each baffle 22 extends entirely around the bank of plates 12, so as to close the space between the bank of plates 12 and the inside wall of the pressure vessel 14, as shown in FIG. 6, except for a slight gap 24 between the baffle 22 and the bank of plates 12, as shown in FIG. 2.

As can be seen from FIGS. 1 and 2, the baffles 22 are downwardly inclined from the inside wall of the vessel 14 to the bank of plates 12. In the present example the angle of inclination is about 45° but this angle can vary depending on such factors as the type of size of the material being heated or cooled.

In the present example where iron carbide fines is being cooled, it has been found that an angle of 45° results in a steady state in which an amount of the fines being cooled leaks through the openings between the plates 12 in the bank of plates 12 to form a layer of material 26 on the baffles 22 with an angle of repose such that no further material build-up on the baffles 22 takes place.

In this way, a layer of material forms on each baffle 22 which effectively forms a gas barrier or pressure seal around the bank of plates 12. The stagnant material also serves as a heat insulator.

In operation, the particulate material to be cooled, which in the present example is iron carbide, is introduced into the feed hopper 19. The feed of material can either be in a continuous mode or a batch mode. The material will fall through the flow passages between the plates 12 and fill the conical lower part 25 of the pressure vessel 14. In this way, a choked mass flow of the material through the bank of heat exchanger plates 12 is achieved to provide for optimum cooling. During this time cooling water is pumped through the heat exchange plates 12.

During the flow of material through the passages between the plates 12, some of the material will flow out sideways through the openings between adjacent plates 12 and is captured by the baffles 22, as shown at 26. Some material also flows through the gaps 24 adjacent to the end plates 12.1 and 12.2 and is also captured by the baffles 22, as shown at 26. All this material forms a layer 26 with an angle of repose so that further outward flow of material ceases and effectively four separate chambers 28, 30, 32, and 34 are formed along the bank of plates 12 with the material layers 26 forming gas barriers which isolate the successive chambers from one another. Thus, in the upper chamber 28, pressure of the process gases of about 50 p.s.i. will prevail. In the second chamber 30, the pressure is somewhat lower, the material layer 26 between the chambers 28 and 30 effectively sealing the chamber 30 from the higher pressure in chamber 28. The same applies to next chamber 32 where the pressure is still lower and also for the chamber 34 where the pressure is even lower, so that the cooled material exiting through the outlet 13 can be released at atmospheric pressure. In this way, a pressure reduction is achieved during the cooling process where, in the present example, the pressure is reduced from about 50 p.s.i. in the chamber 28 to atmospheric pressure at the outlet 13.

In the upper chamber 28 leakage of particulate material onto the upper baffle 22 is also permitted from between the end plates 12.1 and 12.2 and the encasement 16.

Figure 7:
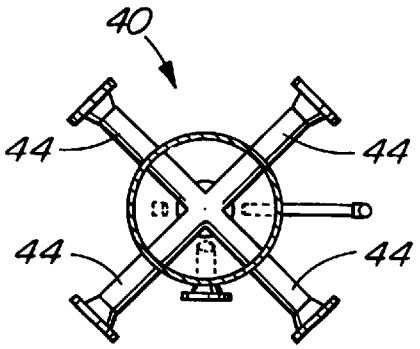
Figure 8:
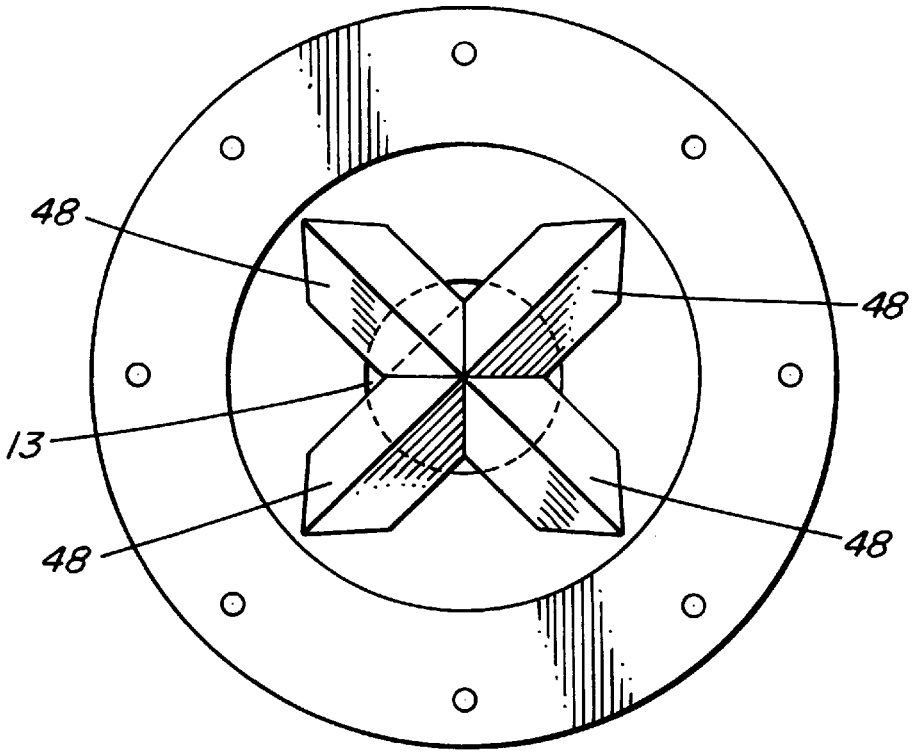
FIG. 8 is a plan view of the interior of an outlet cone of the apparatus of FIG. 1.
Figure 9:
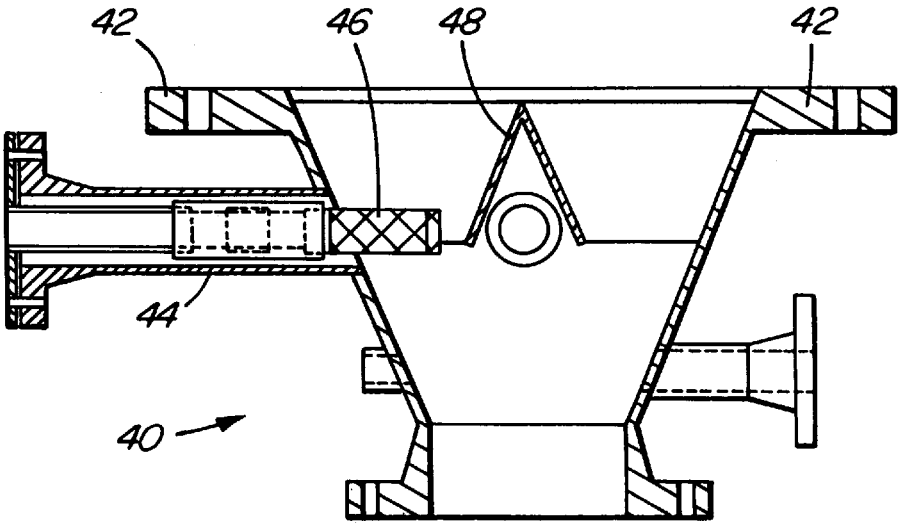
FIG. 9 is a longitudinal section through the cone of FIG. 8.

In addition to achieving a pressure reduction, the arrangement counteracts the process gases from reaching the outlet 13 so that the cooled product exits at the outlet 13 effectively gas free. However, in order to make provision for any gases which may reach the outlet 13, the cooler 10 includes an outlet cone 40 at its lower end in which the outlet opening 13 is provided (FIGS. 7 to 9). The cone 40 is conveniently bolted onto the lower conical part 25 of the apparatus through flanges 42. As can be seen the cone 40 has a much steeper wall angle (typically greater than 65°) than the angle of decline of the baffles 22.

Four radially oriented outlet vents 44 are provided in the outlet cone 40. Each vent 44 is provided with a filter element 46 for filtering any gases escaping therethrough. Each filter element 46 is covered by a shroud 48 formed by a pair of inclined members, each at an angle of about 22° to the vertical. The shrouds 48 keep the filter elements 46 clear from the particulate material being cooled, forming a gas cavity around the filter elements 46.

The vents 44 are connected to pipes (not shown) for conveying any escaped gases to be treated or otherwise disposed of.

In order to provide for the large temperature differential existing along the length of the bank of plates 12, provision is made for the differential expansions which will occur. For example, expansion joints 50 are provided on the coolant inlet 18 and coolant outlet 20. Cross members 51 on one pair of opposite sides of the casing (FIG. 1) of the bank of plates 12 are provided with mitre cuts 52 to provide for differential expansion along the bank of plates 12. Cross members 53 on the other pair of opposite sides of the casing (FIG. 2) are fixed at one end 53.1 to upright support members 55 but are capable of sliding movement with respect to the support members 55 at the other end 53.2. The upper part of the casing, which is at a higher temperature, will be subjected to greater expansion than the lower part, which is at lower temperature. The header 54 feeding coolant to the plates 12 is fixed at one end 54.1 but is capable of sliding at the other end 54.2 (FIG. 5). Expansion spacings 56 are also provided between the baffles 22 and the cross members 51 of the casing of the bank of plates 12. Although some leakage of material occurs through these openings 56, it has been found that this does not interfere with the formation of the material layers 26.

While the above example has been described with reference to a cooling process, it will be appreciated that the pressure reduction heat exchange process and apparatus of the invention can also be applied to a heating process. In such a case a heating fluid, instead of a cooling fluid, will be circulated through the heat exchange plates 12.

While only preferred embodiments of the invention have been described herein in detail, the invention is not limited thereby and modifications can be made within the scope of the attached claims.

What is claimed is:

1. A method of effecting pressure reduction during a heat exchange operation, comprising the steps of:

introducing material to be subjected to heat exchange in particulate form into flow passages defined between a plurality of spaced heat exchange elements in a pressure vessel;

permitting the material to flow in choked flow under the force of gravity through the flow passages defined between the heat exchange elements;

permitting a portion of the material to leak from the passages between the heat exchange elements in a direction transversely of the flow passages;

causing the leaked material to accumulate in a space adjacent the heat exchange elements to form a gas barrier between the heat exchange elements and the pressure vessel.

2. The method according to claim 1, further comprising the step of causing the leaked material to accumulate at a plurality of spaced locations along the heat exchange elements to form a plurality of separate gas barriers along the heat exchange elements.

3. The method according to claim 2, wherein the leaked material is caused to accumulate in a space surrounding the heat exchange elements to form a gas barrier between the heat exchange elements and the pressure vessel which surrounds the heat exchange elements.

4. The method according to claim 3, wherein the heat exchange elements comprise a plurality of heat exchange plates which are arranged in spaced parallel relationship to form a bank of plates with a rectangular cross-section.

5. The method according to claim 4, wherein the pressure vessel comprises a cylindrical vessel having a circular inside wall extending around the bank of plates.

6. The method according to claim 5, wherein the leaked material is caused to accumulate by means of a plurality of baffles spaced along the bank of plates, the baffles extending between the inside wall of the pressure vessel and the bank of plates.

7. The method according to claim 6, wherein the baffles are inclined downwardly from the inside wall of the vessel towards the bank of plates.

8. The method according to claim 1, in which the heat transfer comprises cooling of the particulate material.

9. A heat exchanger, comprising:

a pressure vessel having a feed inlet in an upper part thereof for particulate material to be subjected to heat exchange and an outlet at a lower part thereof for the outflow of particulate material from the vessel;

a plurality of heat exchange elements arranged in spaced relationship inside the pressure vessel to define flow passages between adjacent heat exchange elements for particulate material which is to be subjected to heat exchange to flow therethrough under the force of gravity;

wherein the pressure vessel has an inside wall extending around the heat exchange elements and further comprising a trap between the heat exchange elements and the inside wall for trapping particulate material leaking from the flow passages between the heat exchange elements to form a gas barrier between the heat exchange elements and the pressure vessel.

10. The apparatus according to claim 9, wherein a plurality of said traps, spaced along the heat exchange elements, are provided to form a plurality of separate gas barriers along the heat exchange elements.

11. The apparatus according to claim 10, wherein said traps surround the heat exchange elements for forming successive gas barriers between the heat exchange elements and the pressure vessel which extend around the heat exchange elements.

12. The apparatus according to claim 11, wherein the heat exchange elements comprise a plurality of heat exchange plates which are arranged in spaced parallel relationship to form a bank of plates with a rectangular cross-section.

13. The apparatus according to claim 12, wherein the traps comprise a plurality of baffles spaced along the bank of plates, the baffles extending between the inside wall of the pressure vessel and the bank of plates.

14. The apparatus according to claim 13, wherein the baffles are inclined downwardly from the inside wall of the vessel towards the bank of plates.

15. The apparatus according to claim 14, wherein the pressure vessel comprises a cylindrical vessel and said inside wall is circular.

16. The apparatus according to claim 15, wherein a lower part of the apparatus which is located between the heat exchange elements and said outlet, is conically shaped.

17. The apparatus according to claim 1, further comprising a gas vent downstream of the heat exchange elements for releasing gas from the apparatus.

18. The apparatus according to claim 17, wherein the gas vent is provided with a gas filter for filtering the gas exiting through the vent and further comprising a shroud for screening the filter from particulate material in the apparatus.

19. The apparatus according to claim 18, wherein the apparatus comprises a lower conical portion containing said outlet for the outflow of particulate material and wherein said gas vent is provided in said conical portion.

20. The apparatus according to claim 19, wherein a plurality of said gas vents are provided, the gas vents being radially oriented and spaced around the circumference of said conical portion.

* * * * *